United States Patent [19]

Bailey

[11] 4,001,759

[45] Jan. 4, 1977

[54] VARIABLE ELECTRIC RESISTOR DEVICE

[75] Inventor: David E. Bailey, Belleville, Canada

[73] Assignee: The Raymond Lee Organization, Inc., New York, N.Y. ; a part interest

[22] Filed: Dec. 22, 1975

[21] Appl. No.: 643,244

[52] U.S. Cl. ..... 338/68; 338/87; 338/92; 338/197; 338/202

[51] Int. Cl.[2] ..... H01C 13/00

[58] Field of Search ..... 338/68, 87, 92, 137, 338/139, 140, 184, 185, 192, 195, 197, 202

[56] References Cited

UNITED STATES PATENTS 2,484,117 10/1949 Payne ..... 338/87

*Primary Examiner*—C. L. Albritton
*Attorney, Agent, or Firm*—Daniel Jay Tick

[57] ABSTRACT

A variable electric resistor device comprises a block of electrical insulating material. An elongated member of current resistive metal is removably positioned in the insulating material. A pair of electrically conductive terminal leads are each electrically connected to a corresponding end of the current resistive member. An elongated ancillary member of electrically conductive material is embedded in the insulating material in spaced parallel relation with the current resistive member. A plurality of spaced transverse internally threaded bores are formed through the ancillary member. A plurality of spaced bores are formed through the block extending from both sides of the internally threaded bores from the current resistive member to a surface of the block. A plurality of electrically conductive screws are each threadedly coupled to a corresponding one of the threaded bores and extend in the corresponding bore thereof in a manner whereby selected screws are movable into electrical contact with the current resistive member.

3 Claims, 5 Drawing Figures

VARIABLE ELECTRIC RESISTOR DEVICE

DESCRIPTION OF THE INVENTION

The present invention relates to a variable electric resistor device.

Objects of the invention are to provide a variable electric resistor device which is utilized with facility and convenience to provide accurate and concise variations in electrical resistances at higher power ratings than normally available and utilizes a wide selection of rapidly interchangeable resistances.

In order that the invention may be readily carried into effect, it will now be described with reference to the accompanying drawing, wherein.

In the FIGS., the same components are identified by the same reference numerals.

Figure 1:
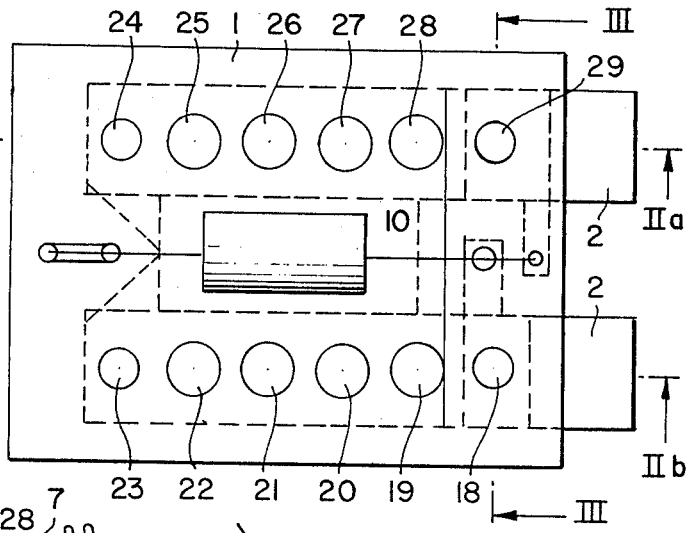
FIG. 1 is a top plan of an embodiment of the variable electric resistor device of the invention.
Figure 2:
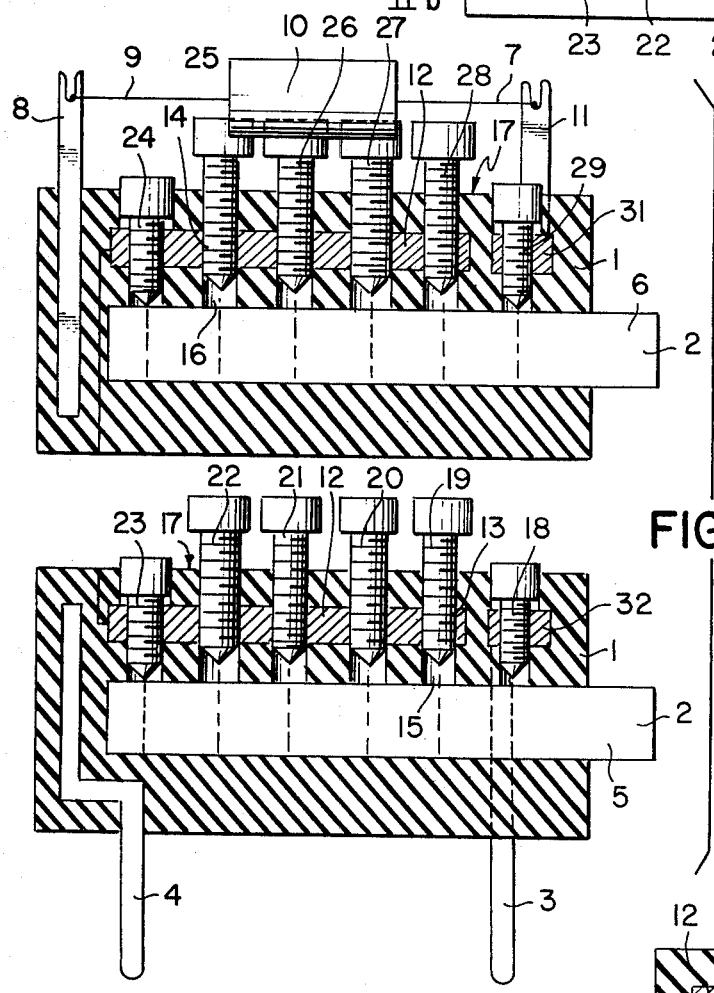
FIG. 2 is a pair of cross-sectional views of the embodiment of FIG. 1, taken in spaced parallel planes II*a* and II*b* of FIG. 1.
Figure 3:
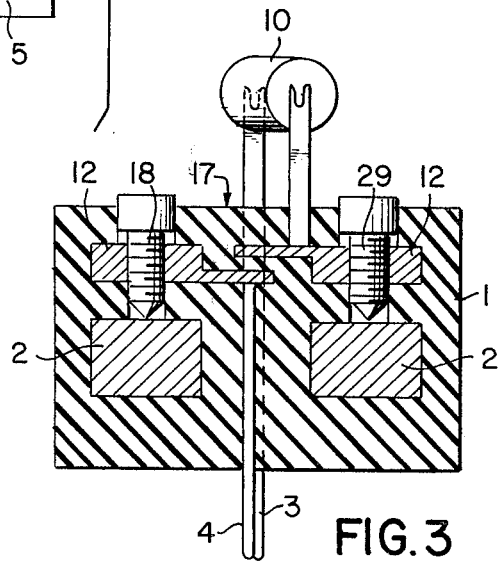
FIG. 3 is a cross-sectional view, taken along the lines III—III, of FIG. 1.

The variable electric resistor device of the invention comprises a block 1 of electrical insulating material of any suitable type (FIGS. 1 to 3).

A substantially elongated member 2 of current resistive metal of any suitable type is removably positioned in the insulating material 1. The member 2 is inserted in a slot so that it is removable to facilitate changing resistive ranges.

Figure 5:
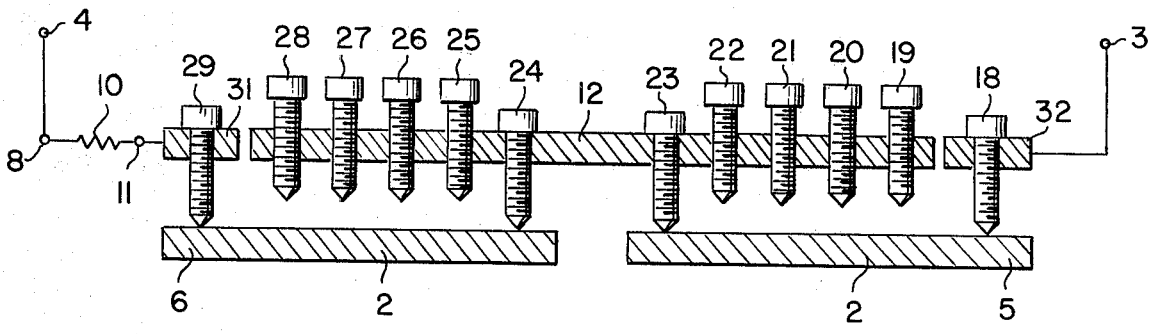
FIG. 5 is a schematic diagram explaining the operation of the resistor device of the invention.

A pair of electrically conductive terminal leads 3 and 4 are provided. The resistive member 2 has an end 5 and an end 6. In the illustrated embodiment of the variable electric resistor device of the invention, the member 2 is shown in two parts, electrically connected by a shorting bar 12 (FIG. 2). The end 6 of the member 2 is connected to the electrically conductive component 11, then through the piggyback resistor 10, then to the electrically conductive component 8 and then to the lead 4. The piggyback resistor 10 is used to set the initial resistive range required by the application of the device. If the block 1 is elongated, however, the member 2 may be provided in a single elongated configuration, as indicated in FIG. 5.

The conductive component 8 is the top end of the terminal lead 4. The conductive component 7 is the lead of the piggyback resistor 10. The lead 4 has a dogleg to provide the proper spacing between the leads 3 and 4 for use in standard PC boards with standard spaced mounting holes.

A substantially elongated ancillary member 12 (FIGS. 2, 3 and 5) of electrically conductive material of any suitable type is embedded in the insulating material of the block 1 in spaced substantially parallel relation with the current resistive member 2. The member 12 is the shorting bar.

A plurality of spaced transverse internally threaded bores 13, 14 and so on (FIG. 2), are formed through the ancillary member 12. A plurality of spaced bores 15, 16, and so on (FIG. 2), are formed through the block 1 extending from both sides of the internally threaded bores 13, 14, and so on, from the current resistive member 2 to a surface 17 of the block (FIGS. 2 and 3).

A plurality of electrically conductive screws 18, 19, 20, 21, 22, 23, 24, 25, 26, 27, 28 and 29 (FIGS. 1, 2 and 5) are provided. Each of the screws 18 to 29 is threadedly coupled in a corresponding one of the threaded bores 13, 14, and so on, and extends in the corresponding bore 15, 16, and so on, thereof in a manner whereby selected screws are movable into electrical contact with the current resistive member 2.

Figure 4:
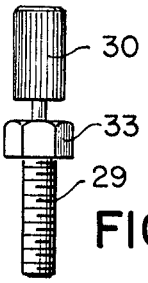
FIG. 4 is a schematic diagram of a screw of the variable electric resistor device of the invention.

Each of the screws 19 to 22 and 25 to 28 has a knurled head 30 (FIG. 4) of electrical insulating material of any suitable type thereon outside the block 1.

Thus, as shown in FIG. 5, the maximum electrical resistance is that between the screws 18 and 29, with none of the intermediate screws 19 to 28 in electrical contact with the member 2. The screws 23 and 24 are always in contact. When any of the intermediate screws 19 to 28, except the screws 23 and 24, are rotated into electrical contact with the member 2, the resistance of the ancillary member 12 shorts out that of the equivalent length of the member 2, so that the electrical resistance provided between the terminals 3 and 4 is, accordingly, less.

The device of the invention is no greater than ¾ inch wide, 1 inch long and ¼ inch thick. The resistive members are nominally ¼ inch wide, ⅛ inch thick and 1 inch long. A great number of resistive members could be stored in a small space.

The block 1 has a channel formed therein parallel to the shorting bar and open at one end to facilitate the installation of resistive members. The resistive members are held in place by the screws 18 and 23 in one section and by the screws 24 and 29 in the other section. Another screw is required to alter the resistance. The additional screw is in either the position 19, 20, 21 or 22 in one section, or 25, 26, 27 or 28 in the other section. The resistance is changed by shorting out the resistive member between the screws 18 and 23 and the screws 24 and 29.

The basic advantages of the device of the invention are rapidly removable resistance members and numerous screw contacts for varying the resistance of resistive members.

The current path of the device is from the lead 3, through a plate 32, contact at the screw 18, the resistive member 2, contacts of the screw 19, 20, 21 or 22, or, if the full resistance of the resistive member is required, through contact with the screw 23 since the ancillary member 12 is a unitary piece of metal, current flows to the other section, through contact of the screw 23, or, if the resistive member is shorted out, by contact of the screw 25, 26, 27 or 28, the resistive member, contact of the screw 29, to a plate 31, the conductive component 11, through the piggyback resistor 10 to the lead 8, which is the upper half of the lead 4.

If the resistive member of the section on the right in FIG. 5 has a total resistance value of 25 ohms between the screws 18 and 23, each screw 19, 20, 21 or 22 which shorts out part of the resistive member, starting from the screw, 23, is 5 ohms. If the resistive member of the section on the left in FIG. 5 has a total resistance value of 5 ohms between the screws 24 and 29, each screw 25, 26, 27 or 28 which shorts out part of the resistive member, starting from the screw 24, is 1 ohm.

Thus, if a resistance of 1030 ohms is required in the circuit using a 1000 ohm piggyback resistor, the specification of the aforedescribed circuit would be between 1006 ohms and 1055 ohms in precise increments of 1 ohm. This may be lowered to 1000 ohms at the low end by using metal shorting components in place of the resistive members.

If a resistance of 270 kilohms is required, a piggyback resistor 10 having a resistance value of 240 kilohms is used. The resistive member of the section on the right has a total resistance value of 10 kilohms, at 2 kilohms per screw and the section of the left has a total resistance value of 50 kilohms, at 10 kilohms per screw. The specifications would thus be 252 kilohms to 300 kilohms in 2 kilohm steps. Shorting elements may lower the bottom and to 240 kilohms.

While the invention has been described by means of a specific example and in a specific embodiment, I do not wish to be limited thereto, for obvious modifications will occur to those skilled in the art without departing from the spirit and scope of the invention.

I claim:

1. A variable electric resistor device, comprising a block of electrical insulating material;

a substantially elongated member of current resistive metal removably positioned in the insulating material;

a pair of electrically conductive termial leads each electrically connected to a corresponding end of the current resistive member;

a substantially elongated ancillary member of electrically conductive material embedded in the insulating material in spaced substantially parallel relation with the current resistive member;

a plurality of spaced transverse internally threaded bores formed through the ancillary member;

a plurality of spaced bores formed through the block extending from both sides of the internally threaded bores from the current resistive member to a surface of the block; and a plurality of electrically conductive screws each threadedly coupled in a corresponding one of the threaded bores and extending in the corresponding bore thereof in a manner whereby selected screws are movable into electrical contact with the current resistive member.

2. A variable electric resistor device as claimed in claim 1, wherein each of the screws has a knurled head of electrical insulating material thereon outside the block.

3. A variable electric resistor device as claimed in claim 2, wherein each of the screws has a screw body and a thin metal portion connecting the head to the screw body to facilitate removal of the head after final adjustment of the screw.

* * * * *